United States Patent [19]

Smith et al.

[11] 3,986,465

[45] Oct. 19, 1976

[54] CLOTH FEED SYSTEM FOR TUFTING MACHINE HAVING LOOSE YARN END EXTRACTOR

[75] Inventors: Randel Pembroke Smith; Alvin Truitt Bonner, Sr., both of Chattanooga, Tenn.

[73] Assignee: The Singer Company, New York, N.Y.

[22] Filed: Apr. 13, 1976

[21] Appl. No.: 676,457

[52] U.S. Cl. ..... 112/79 R

[51] Int. Cl.[2] ..... D05C 15/14

[58] Field of Search ..... 112/79 R, 79 A, 78, 112/79 FF; 26/2 R, 28

[56] References Cited

UNITED STATES PATENTS

| | | | |
|---|---|---|---|
| 1,186,504 | 6/1916 | Wagner | 26/2 R |
| 2,922,214 | 1/1960 | Gilbreath, Jr. | 26/2 R |
| 3,259,088 | 7/1966 | Rockholt | 112/79 R |
| 3,547,058 | 12/1970 | Brown et al. | 112/79 R |
| 3,881,432 | 5/1975 | Dodd et al. | 112/79 R |

*Primary Examiner*—H. Hampton Hunter

*Attorney, Agent, or Firm*—Edward L. Bell; Robert E. Smith; Alan Ruderman

[57] ABSTRACT

A cloth feed take off system for a cut pile control needle tufting machine having a yarn tail extractor for removing the loose strand of yarn formed by the initial stitch each needle makes upon reactivation. The cloth feed take off system maintains high tension in the cloth in the stitch forming section while providing a lower tension in the cloth in the yarn tail extractor section.

5 Claims, 5 Drawing Figures

CLOTH FEED SYSTEM FOR TUFTING MACHINE HAVING LOOSE YARN END EXTRACTOR

BACKGROUND OF THE INVENTION

This invention relates to a cloth feed system for a tufting machine of the controlled needle variety, and more particularly to a cloth feed take off system that maintains a high tension in the cloth in the vicinity of the stitch forming instrumentalities and allows a lower tension to be optimized in the cloth down-stream in the vicinity of the yarn tail extractor so as not to impede the extraction.

Controlled needle tufting machines are known which operate to skip stitch in accordance with a program for forming tufted designs in a backing fabric or cloth. These machines render selective needles or groups of needles inoperative while the remainder of the needles are operative to pierce the backing fabric upon each stroke of the needle bar. An example of this type of machine is illustrated in U.S. Pat. No. 3,881,432, assigned to assignee of the present invention.

The controlled needle tufting machines are generally cut pile machines in which the loops formed by the operative needles are cut by respective knives acting beneath the bed of the machine. When a loop is cut on the last stitch formed by an operative needle, and the needle is thereafter rendered inoperative for a number of subsequent cycles of the machine, the strand of yarn which remains extending through the needle eye while the needle is inoperative above the backing is unattached to any of the tufts previously formed. The initial loop thereafter formed when the needle is again rendered operative by the program is not locked into the backing so that when the loop is cut a loose strand of yarn, known in the industry as a "tail" protrudes from both sides of the backing. This strand must therefore be extracted. U.S. Pat. No. 2,922,214, illustrates a machine for extracting the loose tail from the backing fabric.

More recently, the tail extractor or "tail picker" as the extractor is known in the art, has been incorporated into the fabric or cloth take-off section of the tufting machine so as to conserve space and to minimize the number of parts required. Generally the fabric take-off section includes a number of rollers for pulling the backing through the tufting machine and maintaining high tension on the fabric for proper loop formation. In the past, controlled needle machines have been used almost extensively for chenille bedspread production. Recent carpet styling demands have now made these machines popular for broadloom or carpet manufacture. The heavier gauge yarns used with carpet have created a problem in the operation of the tail picker that was not previously presented. The tail picker has been found not to extract the tails properly. The loose tails were not being completely extracted.

SUMMARY OF THE INVENTION

It has now been determined that when the tension on the backing in the tail picker section is that required for proper loop formation in the stitch forming section, the open spaces between the lattice structure of the woven backing material are tightened about the loose tails and prevent a withdrawal from the backing. This effect is similar to the well known so-called "Chinese finger trap" whereby the tighter the pull the greater the gripping action.

Thus, the present invention provides a reduced tension on the backing at the tail picker of the tufting machine while maintaining the required high tension in the backing in the stitch forming portion. This is accomplished by effectively splitting the take-off feed rollers into two sections — a high tension section immediately down-stream of the stitch forming instrumentalities, and a controllable lower tension section down-stream of the high tension. The tail picker is located in the second section. The conventional rear spike feed roll is located in the transition zone between the two sections, while an additional roller having a controlled torque transmitting device such as a slip clutch is provided in the section down-stream of the tail picker.

It is therefore a primary object of the present invention to provide a cloth or fabric feed take off-system for a controlled needle tufting machine having a loose yarn tail extractor wherein the fabric is under a higher tension in the stitch forming section up-stream of the extractor than it is in the extractor section.

It is another object of the present invention to provide a fabric feed tension control for the fabric take off members of a controlled needle tufting machine having a loose yarn tail extractor so that the fabric tension through the tail extractor section can be optimized without affecting the tension in the loop forming section.

It is a further object of the present invention to provide in a controlled needle tufting machine having a loose yarn tail extractor a first feed roller section between the needle and the extractor and a second feed roller section after the extractor and wherein the rollers after the extractor apply a lower tension to the backing fabric than that applied to the fabric by the rollers before the extractor.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figures 1, 4:
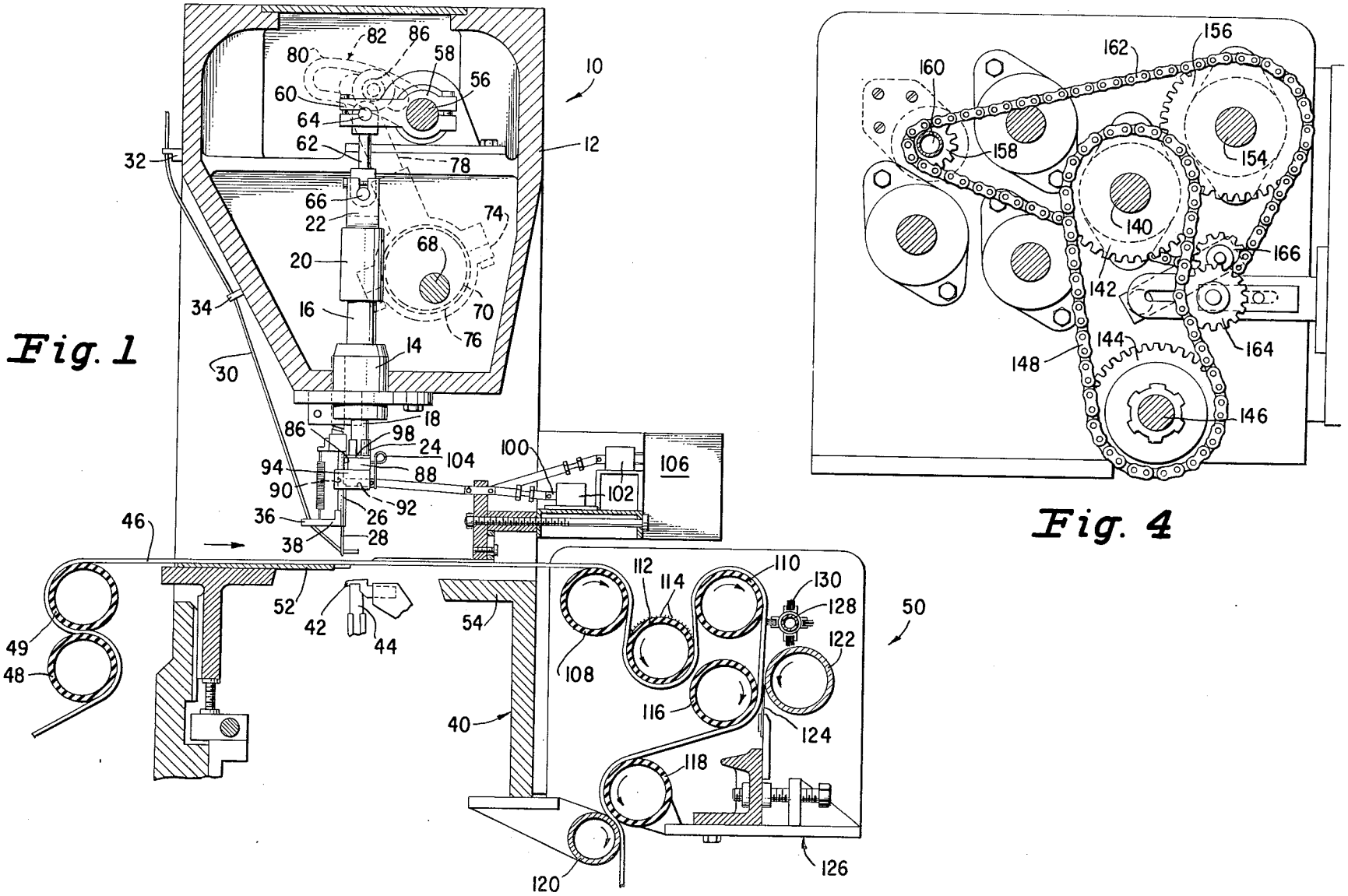
FIG. 1 is a vertical section taken through a controlled needle tufting machine incorporating the features of the present invention.
FIG. 4 is a vertical section taken through the rear fabric feed roller drive train.
Figure 2:
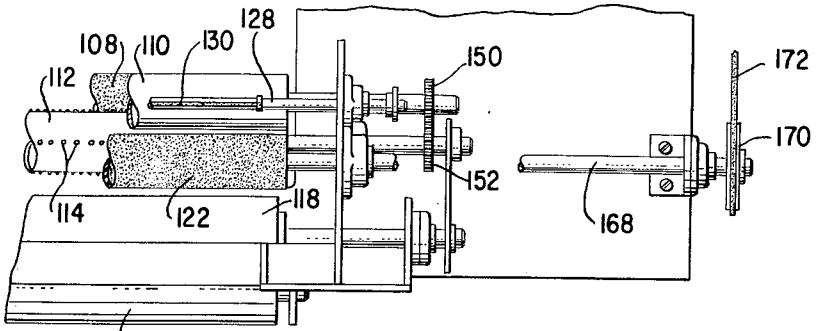
FIG. 2 is a top plan view of the rear fabric feed roller system of the tufting machine of FIG. 1 constructed in accordance with the present invention.

Referring to the drawings, and more particularly to FIG. 1, there is illustrated a tufting machine of the preferred form of the invention. The machine comprises a head 12 within which are secured a plurality of collars 14, only one of which is shown, for supporting respective cylindrical sleeves 16. Journaled for reciprocation within each sleeve 16 is a push rod 18 supporting a concentric cylindrical protective shield 20 adjacent its enlarged split upper end 22. The lower end of the push rod 18 support a single needle bar 24 which extends substantially horizontally the entire length of the machine. Slidably supported for selective coupling to the needle bar are a plurality of needle carriers 26 supporting needles 28. Yarn 30 may be fed to the needles 28 in any conventional manner such as from a conventional overhead creel (not shown) through yarn guides 32 and 34 on the front of the head and guides 36 on brackets 38 secured to the needle carriers.

Below the head 12 in a bed 40 are mounted a plurality of loopers 42 and knives 44 which cooperate with the needles to form cut tufts in a backing fabric 46. Front backing fabric feed rolls 48 and 49 cooperate with a plurality of rear backing fabric feed rolls comprising the rear fabric feed system generally indicated at 50, to be hereinafter described, to feed the backing fabric across a needle plate 52 for presentation to the needles and over a rear bed plate 54.

The push rods 18 may be driven by an adjustable drive similar to that disclosed in U.S. Pat. No. 3,881,432, assigned to the assignee of the instant application, and to which reference can be had for a fuller description thereof. This mechanism generally comprises a main shaft 56 rotatably mounted in the top of the head 12. For each push rod 18 there is a rock arm 58 extending radially from the shaft to provide a crank arm 60 having a split end conventionally connected to a connecting link 62 by a wrist pin 64 journaled in the top of the link. A similar wrist pin 66 may connect the lower end of the link to the enlarged split upper end 22 of the push rod 18. The rocking motion of the shaft 56 thus effects a reciprocating motion to the push rods and hence the needles.

Rocking motion is supplied to the main shaft 56 through means including a cam shaft 68 mounted in the head 12 below and substantially parallel to the shaft 56 and driven at one end of the machine by conventional means. A circular eccentric cam 70 is secured preferably adjacent each end of the shaft 68 and rotates thereby. A connecting rod 72 having a lower split end section 74 is journaled on a sleeve 76 on the eccentric cam. The lower end 78 of the connecting rod is connected in a slotted arcuate arm 80 of a drive lever 82 secured at one end of the shaft 72. Positioned within the slot 84 of the arm 80 is a bolt 86 connecting the connecting rod 72 to the drive lever 82 within the slot 84.

The needle bar 24 comprises a block 88 having a plurality of substantially vertical bores 90 formed for slidably receiving the needle carriers 26, and a plurality of substantially horizontal bores 92 for slidably receiving a latch pin 94 for each needle carrier. Each needle carrier 26 has a recess 96 formed in the upper portion for receiving a detent plate 98 mounted on the top portion of the needle bar and for receiving one end of the latch pin 94. Each latch pin is connected by linkage to one end of an armature 100 of a solenoid 102. When a solenoid or group of solenoids is electrically activated, the withdrawal of the armature effects a pulling on the latch pin 94 from the recess 90 thereby disengaging the corresponding needle carrier 26 from the needle bar 24. When the solenoid is deactivated a spring 104 urges the pin 94 into the recess 90 so that the needle bar drives the corresponding needle carrier and needle. Activation and deactivation of the respective solenoids is controlled by a pattern control mechanism designated generally by numeral 106. Any conventional pattern control may be utilized to control the solenoids according to a pattern. For a fuller description of the operation of the tufting machine reference may be had to the aforesaid U.S. Pat. No. 3,881,432.

The rear fabric feed roller system 50 includes a pair of spaced apart rubber-covered idler feed rollers 108 and 110 rotating in a first direction as indicated in FIG. 1 and a drive roller 112 having a multiplicity of spikes 114 intermediate the rollers 108 and 110 and driven in the opposite direction thereto. The backing 46 is trained in serpentine fashion about the rollers so as to be fed and pulled rearwardly. The speed of rotation of the combination of the rollers 108, 110 and 112 acting with the front rollers 48 and 49 apply a high tension on the backing 46 therebetween so that the tension on the backing at the location of the stitch forming instrumentalities is optimized. The backing fabric thereafter is fed downwardly into engagement with the periphery of an adjustable rubber covered guiding roller 116 and about the periphery of a rubber covered drive roller 118 and held in contact with the latter by a plane surface idler or guide roller 120 from whence it is fed to the take-off or storage location.

Between the rollers 110 and 116 and acting on the backside of the fabric, i.e., the side opposite to that from which the tufted pile extends, is a tail picker or loose yarn extractor roller 112. The roller 122 is preferably emery covered and acts in conjunction with a stripper blade 124 to pull the loose yarn ends from the backing. The stripper blade 124 is supported from a bracket 126 which as illustrated may also support the second drive roller 118. Preferably mounted above the tail picker roller 112 is a brush roll 128 having brushes 130 extending radially therefrom to stand the loose yarn ends or tails proud so that the picker roller 122 may bend them about the blade 124 and thereby extract them.

Timed rotation of the rear feed roller assembly and the extractor assembly is supplied from a pulley 132 mounted on at least one end of the cam shaft 68. A belt 134 is trained about the pulley 132 and about a pulley 136 of a reduction gear box 138. The output shaft of the gear box 138 is coupled to a shaft 140 on which the roller 112 is fixed. Mounted on the shaft 140 is a sprocket 142. Another sprocket 144 having less teeth than that of the sprocket 142 is mounted on the shaft 146 of the second drive roller 118 as hereinafter described. A chain 148 is trained about the sprockets 142 and 144 so as tend to drive the shaft 146 at a slightly faster speed than that of roller 112. Also mounted on the shaft 140 is a gear 150 which meshes with a gear 152 fast on the shaft 154 on which roller 108 is secured. Thus, the roller 108 is driven in timed relationship with the roller 112. Fixed on the shaft 154 of the roller 108 is a sprocket 156 and a further sprocket 158 is fixed on shaft 160 of the brush roller 128. A chain 162 is trained about the sprockets 156 and 158 so as to drive the brush roller in timed relationship with the roller 108. Of course, conventional adjustable idle sprockets 164 and 166 may be incorporated to maintain the proper tension on the respective chains 148 and 162.

The picker roller 122 is mounted on a shaft 168 on the end of which a pulley 170 is fixed. A belt 172 is trained about the pulley 170 and a further pulley (not shown) is mounted on the machine shaft 68 so as to be driven thereby. The rollers 110 and 116 are free turning rollers driven by the friction of the tufted fabric fed in contact therewith. Thus all of the roller shafts in the rear feed assembly and the extractor assembly are driven in timed relationship.

Figure 5:
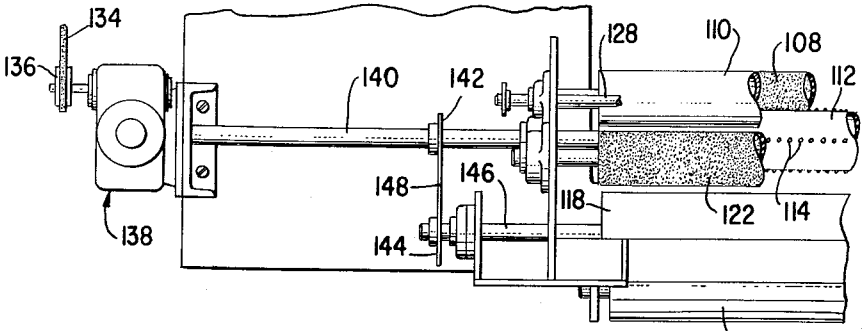
FIG. 5 is a cross-sectional view taken substantially through the preferred torque limiter of the present invention for maintaining the fabric at a lower tension at the extractor then at the stitch forming instrumentalities.
Figure 5:
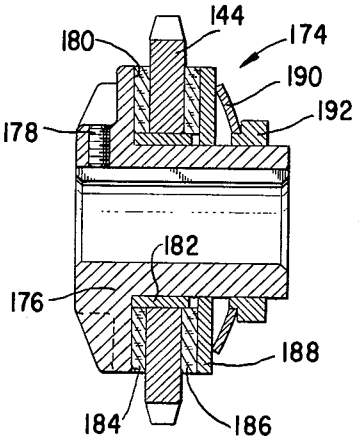
Figure 3:
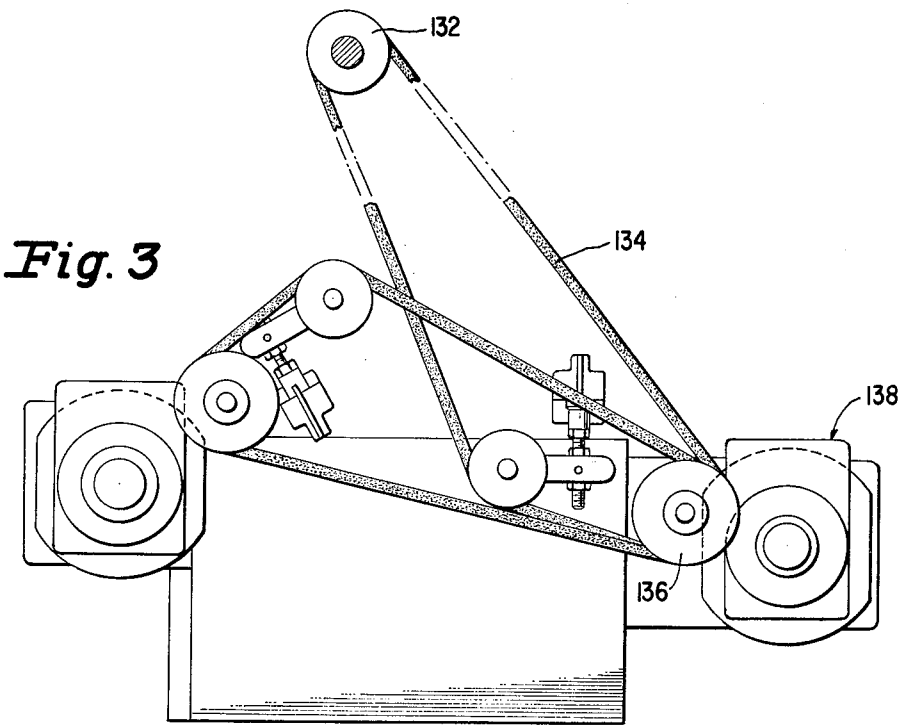
FIG. 3 is an elevational view of the rare fabric feed roller input drive.

The second drive roller 118 is mounted a shaft 146 by means of a torque limiter device generally indicated at 174 as best illustrated in FIG. 5. The torque limiter, which preferably is an off-the-shelf item manufactured by Morse comprises a hub member 176 having an integral pressure plate 180 keyed onto the shaft 146 and held thereon by a set screw 178. A bushing 182 is mounted on the hub member in abutting relationship with the plate 180. Mounted on the bushing and abutting the plate 180 is a first friction disc 184. The sprocket 144 is thereafter mounted on the bushing and abuts the disc 184 and a second friction disc 186 is thereafter mounted on the bushing abutting the other side of the sprocket. Mounted on the hub abutting the side of the disc 186 opposite to that abutting the sprocket 144 is a pressure plate 188 engaged on its other side by a disc spring 190. A nut 192 is threaded onto the hub to act against the spring and thereby adjust the torque transmitted from the sprocket 144 to the shaft 146. When the torque is above the preset limit, the friction discs 184 and 186 slip relative to the sprockets 144 and the plate 180 of the hub 176. Thus, the limiter acts as a slip clutch and does not transmit torque above the set amount from the sprocket 144 to the shaft 146.

In operation soon after the tufting machine is started and reaches operating speed, the thrust limiter 174 begins to slip since the sprocket 144 is turning faster than the sprocket 142 while the rollers 112 and 118 are effectively turning at the same speed. Since less torque is applied to the roller 118 it exerts a lesser tension on the backing than the roller 112, so the tension on the backing is higher between the roller 112 and the stitch forming instrumentalities, i.e., the needles, than it is between the roller 112 and the roller 118. This allows the proper high tension in the stitch forming section and the lower tension in the picker or extractor section. Optimization of the tension in the latter section is possible by adjusting the nut 192.

Numerous alterations of the structure herein disclosed will suggest themselves to those skilled in the art. It is to be understood that this disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. In a controlled needle tufting machine, means for supporting a backing fabric, a needle bar positioned on one side of the backing fabric, means for reciprocating said needle bar, a multiplicity of yarn carrying needles supported by the machine and extending laterally across said backing fabric, means for selectively coupling selective needles to the needle bar for reciprocating said needles to penetrate through said backing fabric to selectively insert loops of yarn therein, each needle upon being coupled to the needle bar remaining so coupled for at least two loop inserting reciprocations, a multiplicity of loop seizing members located on the other side of said backing fabric for entering and holding respective loops, knife means cooperating with said loop seizing members for shearing each of said loops into two legs of pile, feed means for feeding said backing fabric transversely relatively to the laterally extending direction of said needles from a backing fabric source to a tufted fabric take-off means, a loose yarn end extractor located intermediate said needles and said tufted fabric take-off for removing the loose leg of yarn formed by cutting the first loop made by the initial penetration of each needle each time said needle is coupled to the needle bar, said feed means comprising first roller means about which said fabric is trained positioned between said needles and said extractor for maintaining a first tension in said backing fabric at said needles, means for rotating said first roller means, second roller means about which said fabric is trained positioned between said extractor and the tufted fabric take-off means for maintaining a second tension in said backing fabric at the extractor, and means for rotating said second roller means, said second tension being less than said first tension.

2. In a controlled needle tufting machine as recited in claim 1 wherein said means for rotating said second roller means includes means for limiting the torque transmitted to said second roller means to less than that transmitted to the first roller means.

3. In a controlled needle tufting machine as recited in claim 2 wherein said means for rotating said first and second roller means includes a first drive member secured to said first roller means, a second drive member supported by said second roller means, means for rotating said first drive member in timed relationship with the reciprocation of said needle bar, means in driving engagement with said first and second drive members for rotating said second drive member, said means for limiting the torque comprising a slip clutch positioned intermediate said second drive member and said second roller means and in torque transmitting relationship therewith, said second drive member being rotated faster than said second drive member.

4. In a controlled needle tufting machine as recited in claim 3 wherein said first drive member comprises a first sprocket having a multiplicity of peripheral teeth, said second drive member comprising a second sprocket having a multiplicity of peripheral teeth, the number of teeth on said first sprocket being greater than the number of teeth on said second sprocket, and said means in driving engagement with said first and second drive members comprises an endless chain trained about and meshing with said first and second sprockets.

5. In a controlled needle tufting machine as recited in claim 2 wherein said means for limiting the torque transmitted to the second roller means comprises a slip clutch intermediate said second roller means.

* * * * *

UNITED STATES PATENT OFFICE
CERTIFICATE OF CORRECTION

PATENT NO. : 3,986,465

DATED : October 19, 1976

INVENTOR(S) : Randel P. Smith and Alvin T. Bonner, Sr.

It is certified that error appears in the above-identified patent and that said Letters Patent are hereby corrected as shown below:

Column 4, line 27 "112" should be -- 122 --

Column 4, line 33 "112" should be -- 122 --

Signed and Sealed this

Fourth Day of January 1977

[SEAL]

*Attest:*

RUTH C. MASON
*Attesting Officer*

C. MARSHALL DANN
*Commissioner of Patents and Trademarks*